US008342324B2

(12) United States Patent
Debias

(10) Patent No.: US 8,342,324 B2
(45) Date of Patent: Jan. 1, 2013

(54) SELF-INFLATING WEAPONS CASE

(76) Inventor: Rod Debias, Windber, PA (US)

( * ) Notice: Subject to any disclaimer, the term of this patent is extended or adjusted under 35 U.S.C. 154(b) by 0 days.

(21) Appl. No.: 12/764,487

(22) Filed: Apr. 21, 2010

(65) Prior Publication Data

US 2011/0259770 A1 Oct. 27, 2011

(51) Int. Cl.
*B65D 85/00* (2006.01)
*B65D 81/02* (2006.01)

(52) U.S. Cl. ..... 206/317; 206/522

(58) Field of Classification Search ..... 206/317, 206/522, 315.1, 315.11; 383/3
See application file for complete search history.

(56) References Cited

U.S. PATENT DOCUMENTS

| | | | | |
|---|---|---|---|---|
| 2,573,375 | A * | 10/1951 | Winstead | 206/522 |
| 3,319,685 | A * | 5/1967 | Urban | 383/3 |
| 3,865,166 | A | 2/1975 | Pedro | |
| 4,044,867 | A | 8/1977 | Fisher | |
| 4,155,453 | A * | 5/1979 | Ono | 206/522 |
| 4,215,778 | A | 8/1980 | Kovins | |
| 4,489,833 | A | 12/1984 | Bauer | |
| 4,574,953 | A | 3/1986 | Garbuzov | |
| 4,877,334 | A * | 10/1989 | Cope | 383/3 |
| 5,704,475 | A | 1/1998 | Jack | |
| 6,644,475 | B2 * | 11/2003 | Wilson et al. | 206/522 |
| 6,755,568 | B2 * | 6/2004 | Malone et al. | 383/3 |
| 8,021,734 | B2 * | 9/2011 | Lippy et al. | 206/522 |
| 2001/0013519 | A1 * | 8/2001 | Liebold | 206/522 |
| 2005/0061409 | A1 * | 3/2005 | Chung | 206/522 |
| 2008/0308448 | A1 * | 12/2008 | Allen | 206/522 |

* cited by examiner

*Primary Examiner* — Bryon Gehman
(74) *Attorney, Agent, or Firm* — Gonzalez Saggio & Harlan, LLP

(57) ABSTRACT

The different advantageous embodiments provide an apparatus comprising an inflatable portion, a nozzle, and a non-inflatable portion. The inflatable portion has an interior housing and an inflating system. The inflating system is disposed between a number of layers of material. An interior layer of material from the number of layers of material comprises the interior housing. The number of layers of material are flexible and impervious to penetration by air and moisture. The nozzle is connected to the inflatable portion and configured to control fluid flow to and from the inflating system. The non-inflatable portion is connected to an end of the inflatable portion and has a sealing system configured to seal the interior housing of the inflatable portion.

16 Claims, 5 Drawing Sheets

SELF-INFLATING WEAPONS CASE

BACKGROUND INFORMATION

1. Field

The present disclosure relates generally to storage containers and more particularly to weapon cases.

2. Background

Storage cases for weapons protect a weapon from physical damage and the corrosive effects of atmospheric gases and moisture when the weapon is not in use. These storage cases are also useful in mitigating damage to a weapon during transport of the weapon. Weapon cases are generally formed using a protective material configured with a hollow interior to receive the weapon and some means of closing the case around the weapon.

One common type of weapon case is a gun case formed of a rigid exterior material and a padded interior section for housing the weapon. Other types of cases may be formed using a flexible material, which provides limited protection to the weapon encased within.

Therefore, it would be advantageous to have a method and apparatus that addresses one or more of the issues discussed above.

SUMMARY

The different advantageous embodiments provide an apparatus comprising an inflatable portion, a nozzle, and a non-inflatable portion. The inflatable portion has an interior housing and an inflating system. The inflating system is disposed between a number of layers of material. An interior layer of material from the number of layers of material comprises the interior housing. The number of layers of material are flexible and impervious to penetration by air and moisture. The nozzle is connected to the inflatable portion and configured to control fluid flow to and from the inflating system. The non-inflatable portion is connected to an end of the inflatable portion and has a sealing system configured to seal the interior housing of the inflatable portion.

The features, functions, and advantages can be achieved independently in various embodiments of the present disclosure or may be combined in yet other embodiments in which further details can be seen with reference to the following description and drawings.

BRIEF DESCRIPTION OF THE DRAWINGS

The novel features believed characteristic of the advantageous embodiments are set forth in the appended claims. The advantageous embodiments, however, as well as a preferred mode of use, further objectives and advantages thereof, will best be understood by reference to the following detailed description of an advantageous embodiment of the present disclosure when read in conjunction with the accompanying drawings, wherein:

DETAILED DESCRIPTION

Figure 1:
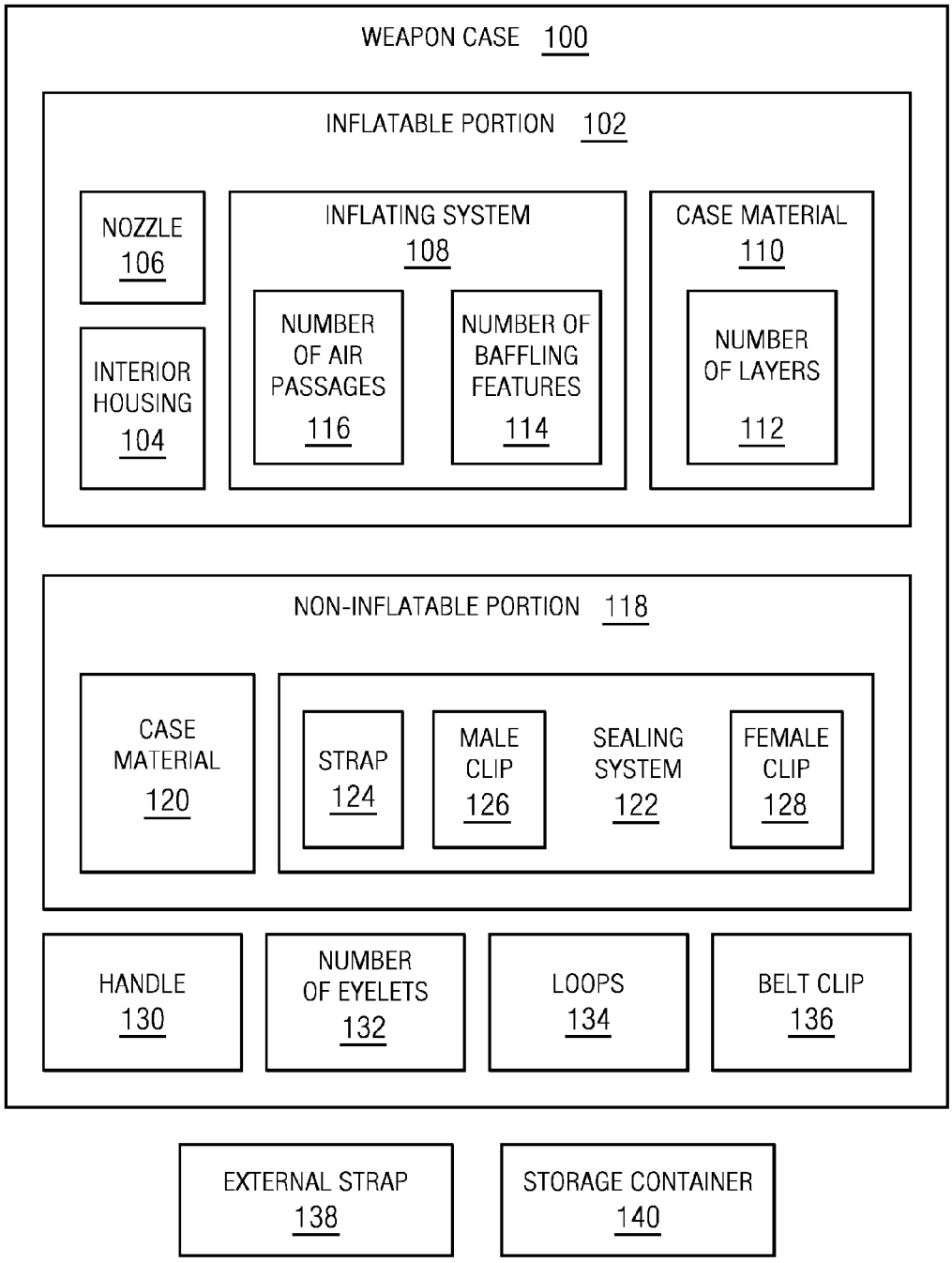
FIG. 1 is an illustration of a weapon case in which an advantageous embodiment may be implemented.

With reference now to the figures and, in particular, with reference to FIG. 1, an illustration of a weapon case is depicted in which an advantageous embodiment may be implemented. Weapon case 100 may be a container for housing any type of weapon, including, for example, without limitation, a rifle, shotgun, pistol, handgun, bow and arrow system, knife, and/or any other suitable weapon.

Weapon case 100 includes inflatable portion 102 and non-inflatable portion 118. Inflatable portion 102 includes interior housing 104, nozzle 106, inflating system 108, and case material 110. Interior housing 104 is a section of weapon case 100 in which a weapon may be encased within inflatable portion 102.

Nozzle 106 may be any type of device configured to control the direction or characteristics of a fluid flow as it exits or enters an enclosed chamber, such as inflating system 108. For example, the fluid flow may be air flow to and from the outside of inflatable portion 102 and inflating system 108. Nozzle 106 may include an open state and a closed state, where the open state allows the fluid flow and the closed state prevents the fluid flow, for example.

Case material 110 is a compressible material that is impervious to penetration by air and moisture. Case material 110 may be any type of material, such as, without limitation, nylon, polyester, polyethylene, impregnated fabric, coated fabric, and/or any other suitable material. A coated fabric may be a natural or synthetic fabric laminated in a material such as, without limitation, rubber, polyvinyl chloride, polyurethane, silicone elastomer, wax, and/or any other suitable waterproofing material. An impregnated fabric may be a natural or synthetic fabric integrated with a waterproofing material, for example.

Case material 110 includes number of layers 112. Number of layers 112 may be one or more layers encompassing inflating system 108. For example, number of layers 112 may include an outer layer and an inner layer, with inflating system 108 disposed between the outer and inner layer. In this example, the inner layer may surround interior housing 104. The cavity between the outer layer and the inner layer may encompass inflating system 108, in this illustrative example.

Inflating system 108 may include number of baffling features 114 and number of air passages 116. Inflating system 108 is a self-inflating system for directing air flow into number of air passages 116 using nozzle 106. Number of baffling features 114 neutralize outside pressure against the inflated case material 110 to keep the air pressure within the inflated case equal. Inflatable portion 102, when inflated, provides a protective buffering for the object within interior housing 104 from forces outside weapon case 100. Number of baffling features 114 is an illustrative example of one implementation of a feature configured to provide number of air passages 116 to inflating system 108. Number of baffling features 114 may be, for example, a material disposed between the interior surfaces of number of layers 112 to support the inflatable internal cavity between number of layers 112 of case material 110.

Nozzle 106 may allow air flow to move through inflating system 108 when nozzle 106 is in an open state, for example, filling number of air passages 116. Number of air passages 116, when filled with air in this illustrative example, may separate number of layers 112 encompassing inflating system 108 to form an inflated state. Nozzle 106 may also be used to allow air flow to exit inflating system 108, such that when number of air passages 116 is empty inflatable portion 102 is in a deflated state.

Non-inflatable portion 118 may include case material 120 and sealing system 122. Case material 120 is a compressible material that is impervious to penetration by air and moisture. Case material 120 may be any type of material, such as, without limitation, nylon, polyester, polyethylene, impregnated fabric, coated fabric, and/or any other suitable material. In one illustrative example, case material 120 may be comprised of the same material as case material 110 of inflatable portion 102. In another illustrative example, case material 120 may be comprised of a different material than that of case material 110.

Case material 120 of non-inflatable portion 118 may be configured as an extension of one end of inflatable portion 102, for example. In this example, case material 120 is disposed at the end of inflatable portion 102 that is opposite from the end of inflatable portion 102 at which nozzle 106 is disposed. Case material 120 may be connected to case material 110 at one end of case material 120 and to sealing system 122 at the other end of case material 120.

Sealing system 122 may be any type of system configured to seal off interior housing 104 of inflatable portion 102. Sealing system 122 may include strap 124, male clip 126, and female clip 128, in one advantageous embodiment. Strap 124 may be disposed along non-inflatable portion 118 perpendicular to non-inflatable portion 118 and inflatable portion 102, with male clip 126 disposed on one end of strap 124 and female clip 128 disposed on the other end of strap 124.

In one advantageous embodiment, case material 120 is configured to be rolled in a compressed manner up to a point when inflatable portion 102 is inflated, such as the point where case material 120 is connected to case material 110 of inflatable portion 102. Strap 124 may be configured to wrap around the rolled and compressed case material 120 to secure male clip 126 and female clip 128 together. Male clip 126 and female clip 128 may form a well known buckle feature, for example. When strap 124 is secured around rolled and compressed case material 120 of non-inflatable portion 118, the opening of weapon case 100 is sealed.

In another advantageous embodiment, case material 120 may be rolled in a compressed manner up to a point, such as the point where case material 120 is connected to case material 110 of inflatable portion 102, with case material 110 also being rolled in a compressed manner once case material 120 is completely rolled and compressed, in order to deflate weapon case 100 into a compressed form for storage, for example.

Weapon case 100 may also include handle 130, number of eyelets 132, loops 134, and belt clip 136. Handle 130 may be any type of material disposed along a portion of the external surface of inflatable portion 102 and configured to provide a feature for carrying weapon case 100 by hand. Number of eyelets 132 may be rings inserted into a hole of any type of material disposed along one or more portions of the external surface of inflatable portion 102. The rings may be, for example, without limitation, metal, plastic, rubber, and/or any other suitable material. These rings may be inserted in a hole of a portion of material, with the material being affixed to or disposed along a portion of inflatable portion 102. Number of eyelets 132 may provide a mechanism for connecting a carrying strap to weapon case 100, such as a shoulder strap for example. In another illustrative example, number of eyelets 132 may provide a mechanism for affixing weapon case 100 to another object.

Loops 134 may be disposed along a number of exterior portions of inflatable portion 102. Loops 134 may be any type of material such as, for example, without limitation, nylon. Loops 134 may provide a mechanism for attachment of weapon case 100 to another object, such as a backpack for example. Belt clip 136 may be disposed along an exterior portion of inflatable portion 102. Belt clip 136 may be any type of material such as, for example, without limitation, plastic. Belt clip 136 may be configured to affix weapon case 100 to a belt for hands-free transportation, for example.

Weapon case 100 may include accompanying features of external strap 138 and storage container 140. External strap 138 may be similar to strap 124 of sealing system 122, having a male clip and female clip disposed at either end of external strap 138 for securing external strap 138 around weapon case 100. External strap 138 may be configured to fit around weapon case 100 when weapon case 100 is in a deflated, compressed, and rolled state, for example. External strap 138 may keep weapon case 100 in the deflated, compressed, and rolled state using pressure, for example, by having external strap 138 secured around rolled weapon case 100 with a buckle feature, for example. Any other type of securing mechanism may be associated with external strap 138. For example, external strap 138 may be comprised of a material with elastic characteristics. In this illustrative example, external strap 138 is a continuous loop of material that can be stretched to fit around rolled weapon case 100, contracting to keep weapon case 100 in the deflated, compressed, and rolled state using pressure inherent to the elastic characteristic of the material.

In another illustrative example, storage container 140 may be a container configured to house weapon case 100 in a deflated, compressed, and rolled state. Storage container 140 may keep weapon case 100 in a deflated, compressed, and rolled state due to the size of storage container 140 preventing expansion of weapon case 100 when weapon case 100 is housed within storage container 140, for example. Storage container 140 may be comprised of any type of material, such as, for example, without limitation, plastic, metal, fabric, nylon, polyester, polyethylene, impregnated fabric, coated fabric, and/or any other suitable material.

The illustration of weapon case 100 in FIG. 1 is not meant to imply physical or architectural limitations to the manner in which different advantageous embodiments may be implemented. Other components in addition and/or in place of the ones illustrated may be used. Some components may be unnecessary in some advantageous embodiments. Also, the blocks are presented to illustrate some functional components. One or more of these blocks may be combined and/or divided into different blocks when implemented in different advantageous embodiments.

For example, although inflatable portion 102 is self-inflating, with nozzle 106 configured to direct air flow into inflating system 108 without the use of an external pressure source, an external pressure source may be used to accelerate the inflation of weapon case 100 in one advantageous embodiment. In another advantageous embodiment, inflating system 108 may comprise a closed cell foam structure for inflation of inflatable portion 102.

As used herein, the phrase "at least one of", when used with a list of items, means that different combinations of one or more of the items may be used and only one of each item in the list may be needed. For example, "at least one of item A, item B, and item C" may include, for example, without limitation, item A or item A and item B. This example also may include item A, item B, and item C or item B and item C.

The different advantageous embodiments recognize and take into account that current weapon cases are either implemented as a hard shell case or a soft shell flexible case encasing open cell foam to encapsulate a weapon, for example. The hard shell cases, while waterproof and impact resistant, can be heavy and bulky, difficult to pack, and cannot compress into a smaller form. The soft shell case, while flexible, provides limited impact resistance, no buoyancy, and limited weather-proofing capabilities.

Thus, the different advantageous embodiments provide an apparatus comprising an inflatable portion, a nozzle, and a non-inflatable portion. The inflatable portion has an interior housing and an inflating system. The inflating system is disposed between a number of layers of material. An interior layer of material from the number of layers of material comprises the interior housing. The number of layers of material are flexible and impervious to penetration by air and moisture. The nozzle is connected to the inflatable portion and configured to control fluid flow to and from the inflating system. The non-inflatable portion is connected to an end of the inflatable portion and has a sealing system configured to seal the interior housing of the inflatable portion.

Figure 2:
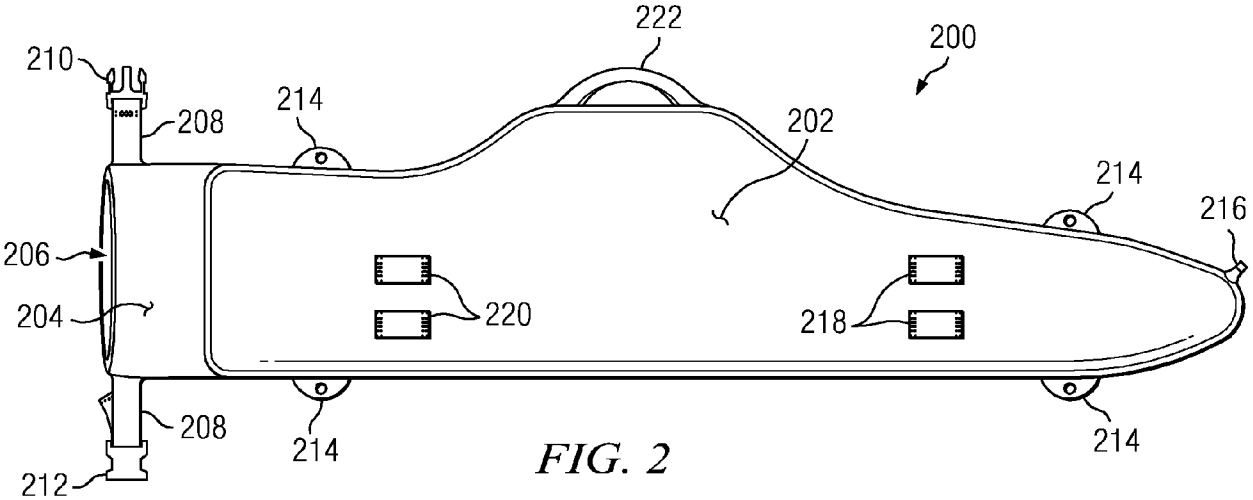
FIG. 2 is an illustration of a weapon case in which an advantageous embodiment may be implemented.

With reference now to FIG. 2, an illustration of a weapon case is depicted in accordance with an advantageous embodiment. Weapon case 200 is an illustrative example of one implementation of weapon case 100 in FIG. 1.

Weapon case 200 may be an illustrative example of a self-inflating case designed to house a rifle or shotgun, for example. Weapon case 200 may illustrate an inflated state, for example, in which a weapon or object may be inserted into weapon case 200 for storage and/or transportation. Weapon case 200 includes inflatable portion 202, non-inflatable portion 204, opening 206, strap 208, male clip 210, female clip 212, number of eyelets 214, nozzle 216, loops 218, loops 220, and handle 222. Inflatable portion 202 may be in illustrative example of one implementation of inflatable portion 102 in FIG. 1. Non-inflatable portion 204 may be in illustrative example of one implementation of non-inflatable portion 118 in FIG. 1.

Non-inflatable portion 204 is connected at one end to inflatable portion 202, and at the other end provides opening 206. Opening 206 is provided to insert and remove an object, such as a weapon, from weapon case 200. Opening 206 is sealed by rolling non-inflatable portion 204 in a compressed manner towards the area where non-inflatable portion 204 connects with inflatable portion 202, and securing rolled and compressed non-inflatable portion 204 using strap 208. Strap 208 includes male clip 210 and female clip 212, in this example, for securing either end of strap 208 together to hold rolled and compressed non-inflatable portion 204 in place.

Number of eyelets 214 is disposed along the bottom and top portions of weapon case 200, in this example, to provide a mechanism for affixing weapon case 200 to another object or carrying strap, for example. Nozzle 216 is disposed at the end of inflatable portion 202 opposite from non-inflatable portion 204, in this example. When weapon case 200 is deflated, weapon case 200 may be rolled in a compressed manner starting at the end having non-inflatable portion 204, and rolling towards the end having nozzle 216. In this manner, air within inflatable portion 202 may be expelled through nozzle 216 as weapon case 200 is compressed and rolled, for example.

Loops 218 and loops 220 may be disposed along one side of weapon case 200, in this example. Loops 218 and loops 220 may provide a mechanism for affixing weapon case 200 to another object or carrying strap by inserting additional material through loops 218 and loops 220, for example. Handle 222 may be an illustrative example of one implementation of handle 130 in FIG. 1.

The illustration of weapon case 200 in FIG. 2 is not meant to imply physical or architectural limitations to the manner in which different advantageous embodiments may be implemented. Other components in addition and/or in place of the ones illustrated may be used. Some components may be unnecessary in some advantageous embodiments. Also, the blocks are presented to illustrate some functional components. One or more of these blocks may be combined and/or divided into different blocks when implemented in different advantageous embodiments.

For example, weapon case 200 may be implemented with a different securing system other than strap 208, male clip 210, and female clip 212. In another illustrative example, weapon case 200 may be implemented without number of eyelets 214.

In another advantageous embodiment, weapon case 200 may be implemented without non-inflatable portion 204, with strap 208, male clip 210, and female clip 212 connected to the end of inflatable portion 202 opposite from nozzle 216 and configured to compress and roll an end of inflatable portion 202 to form a seal, for example.

Figure 3:
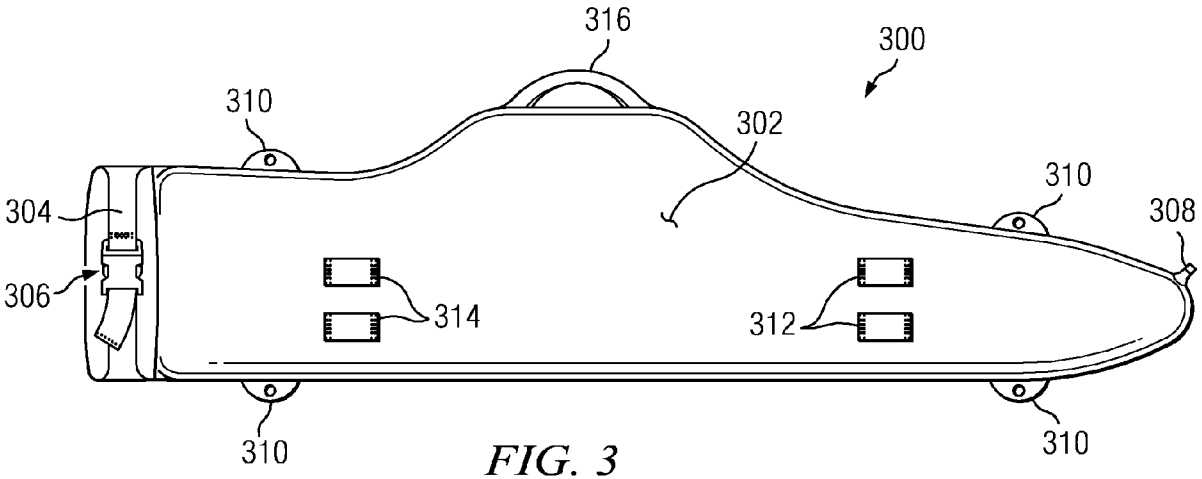
FIG. 3 is an illustration of a weapon case in accordance with an advantageous embodiment.

With reference now to FIG. 3, an illustration of a weapon case is depicted in accordance with an advantageous embodiment. Weapon case 300 is an illustrative example of one implementation of weapon case 200 in FIG. 2 in a sealed state.

Weapon case 300 may be an illustrative example of a self-inflating case designed to house a rifle or shotgun, for example. Weapon case 300 may illustrate an inflated state, for example, in which a weapon or object may be sealed within weapon case 300 for storage and/or transportation. Weapon case 300 depicts inflatable portion 302, strap 304, buckle 306, nozzle 308, number of eyelets 310, loops 312, loops 314, and handle 316. Inflatable portion 302 may be in illustrative example of one implementation of inflatable portion 102 in FIG. 1. Inflatable portion 302 is depicted in an inflated state, having air within the number of layers of material comprising inflatable portion 302. Inflatable portion 302 provides protection and insulation for the object or weapon housed within weapon case 300.

The non-inflatable portion of weapon case 300 is rolled and compressed to seal weapon case 300, secured beneath strap 304 in this illustrative example. Strap 304 forms buckle 306, in this example, to secure strap 304 around the rolled and compressed non-inflatable portion, such as non-inflatable portion 204 in FIG. 2. Buckle 306 may be formed using male clip 210 and female clip 212 of FIG. 2, for example.

Nozzle 308 is disposed at the end of inflatable portion 302 opposite from strap 304, in this example. When weapon case 300 is inflated, nozzle 308 may be in a closed position designed to prevent air flow through nozzle 308. In this manner, air within inflatable portion 302 may be contained to exert pressure against the interior portions of the layers of material that comprise inflatable portion 302, providing buffering and protection for the object housed within weapon case 300, for example.

Number of eyelets 310 is disposed along the bottom and top portions of weapon case 300, in this example, to provide a mechanism for affixing weapon case 300 to another object or carrying strap, for example. Loops 312 and loops 314 may be disposed along one side of weapon case 300, in this example. Loops 312 and loops 314 may provide a mechanism for affixing weapon case 300 to another object or carrying strap. Handle 316 may be an illustrative example of one implementation of handle 130 in FIG. 1.

The illustration of weapon case 300 in FIG. 3 is not meant to imply physical or architectural limitations to the manner in which different advantageous embodiments may be implemented. Other components in addition and/or in place of the ones illustrated may be used. Some components may be unnecessary in some advantageous embodiments. Also, the blocks are presented to illustrate some functional components. One or more of these blocks may be combined and/or divided into different blocks when implemented in different advantageous embodiments.

For example, a securing mechanism other than buckle 306 may be used to keep strap 304 in place to secure and seal a non-inflatable portion of weapon case 300.

Figure 4:
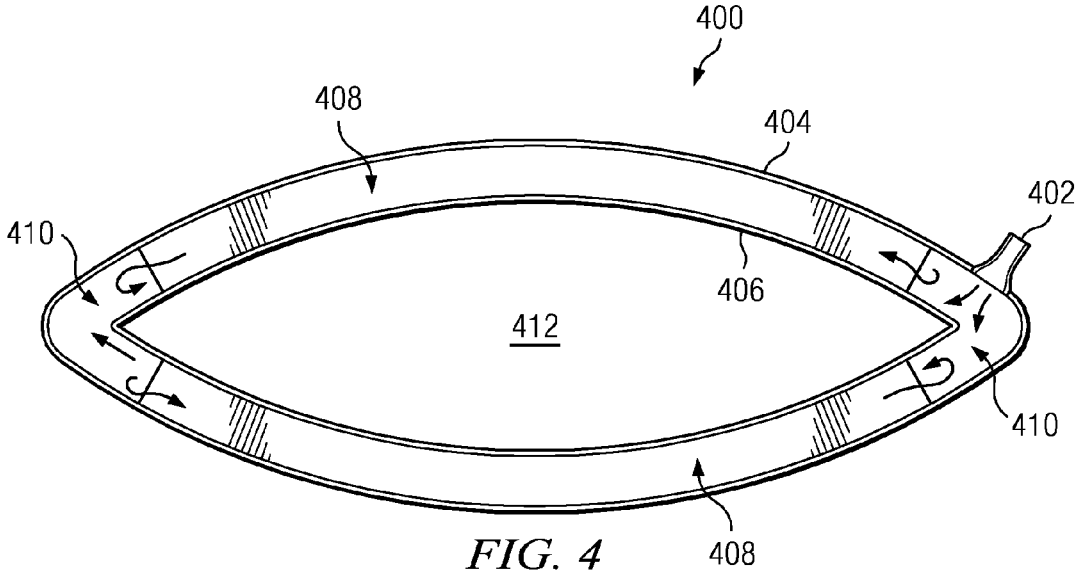
FIG. 4 is an illustration of an inflatable portion cross-section in accordance with an advantageous embodiment.

With reference now to FIG. 4, an illustration of an inflatable portion cross-section is depicted in accordance with an advantageous embodiment. Inflatable portion cross-section 400 may be an illustrative example of one implementation of a cross sectional view of inflatable portion 202 in FIG. 2 and/or inflatable portion 302 in FIG. 3.

Inflatable portion cross-section 400 includes nozzle 402, exterior layer 404, interior layer 406, baffling feature 408, and air passage 410. Nozzle 402 is an illustrative example of one implementation of nozzle 106 in FIG. 1. Nozzle 402 is disposed along a portion of exterior layer 404. Exterior layer 404 and interior layer 406 are illustrative examples of one implementation of number of layers 112 of case material 110 in FIG. 1.

Baffling feature 408 is an illustrative example of one implementation of number of baffling features 114 in FIG. 1. Baffling feature 408 is disposed between the interior surfaces of exterior layer 404 and interior layer 406. Baffling feature 408 is configured to provide air passage 410 within the space between exterior layer 404 and interior layer 406. Nozzle 402 provides air flow into and out of air passage 410. Air flow may be directed throughout an inflatable portion around baffling feature 408, for example.

In an illustrative example, nozzle 402 may be in an open state, allowing air flow from the exterior of an inflatable portion into air passage 410 within exterior layer 404 and interior layer 406. When air passage 410 is filled with air, nozzle 402 may be switched to a closed state in order to maintain air within air passage 410 and provide an inflated state for the inflatable portion. In this inflated state, case interior 412 may house an object or weapon in a protective environment.

In another illustrative example, nozzle 402 may be switched to an open state to release air from air passage 410. The inflatable portion may be compressed to exclude air from air passage 410 and bring the inflatable portion to a deflated state, for example.

The illustration of inflatable portion cross-section 400 in FIG. 4 is not meant to imply physical or architectural limitations to the manner in which different advantageous embodiments may be implemented. Other components in addition and/or in place of the ones illustrated may be used. Some components may be unnecessary in some advantageous embodiments. Also, the blocks are presented to illustrate some functional components. One or more of these blocks may be combined and/or divided into different blocks when implemented in different advantageous embodiments.

For example, features and/or components other than baffling feature 408 may be used to provide air passage 410. In one illustrative example, an open cell foam structure may be used that fills the space between exterior layer 404 and interior layer 406 and is configured to expand and contract with the addition and exclusion of air, for example.

Figure 5:
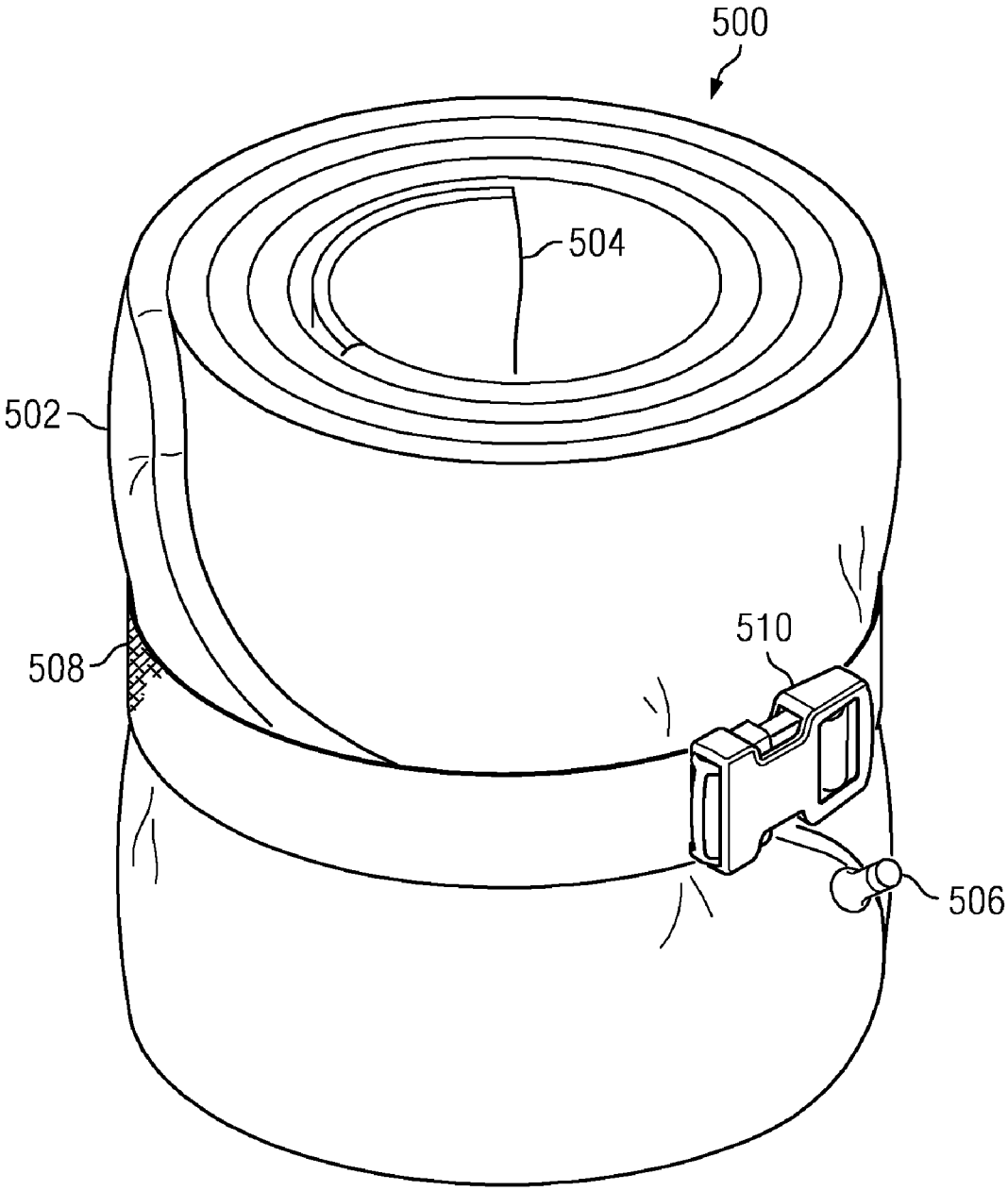
FIG. 5 is an illustration of a weapon case in accordance with an advantageous embodiment.

With reference now to FIG. 5, an illustration of a weapon case is depicted in accordance with an advantageous embodiment. Weapon case 500 is an illustrative example of one implementation of weapon case 100 in FIG. 1.

Weapon case 500 is depicted in a deflated, compressed, and rolled state. Weapon case 500 depicts deflated inflatable material 502, non-inflatable material 504, nozzle 506, strap 508, and buckle 510. Weapon case 500 may be rolled and compressed starting at the end having non-inflatable material 504, so that non-inflatable material 504 is at the innermost portion of the roll created by the rolled and compressed case. Nozzle 506 may be set in an open position to release air during the rolling and compressing of weapons case 500, resulting in air being excluded from deflated inflatable material 502. Strap 508 may secure weapon case 500 in a deflated, rolled, and compressed state using buckle 510, in this example. In these examples, strap 508 is a different strap than strap 208 in FIG. 2 and strap 304 in FIG. 3.

The illustration of weapon case 500 in FIG. 5 is not meant to imply physical or architectural limitations to the manner in which different advantageous embodiments may be implemented. Other components in addition and/or in place of the ones illustrated may be used. Some components may be unnecessary in some advantageous embodiments. Also, the blocks are presented to illustrate some functional components. One or more of these blocks may be combined and/or divided into different blocks when implemented in different advantageous embodiments.

For example, strap 508 may be implemented as a continuous loop of material with an elastic characteristic that holds weapon case 500 in the deflated, rolled, and compressed state using the tension of the elastic characteristic.

Figure 6:
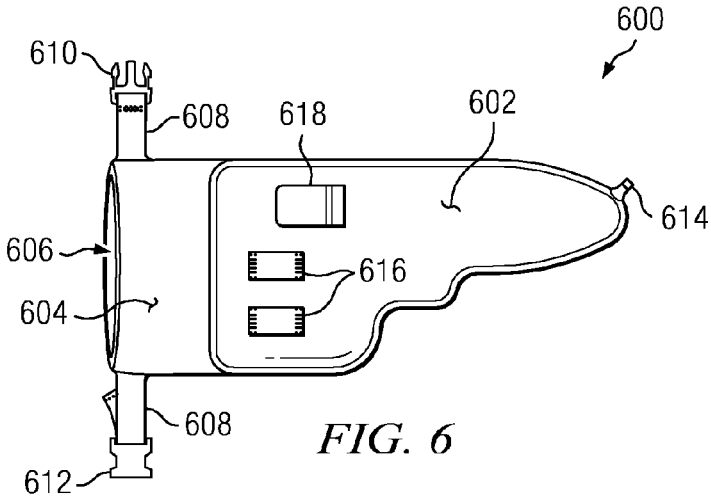
FIG. 6 is an illustration of a weapon case in accordance with an advantageous embodiment.

With reference now to FIG. 6, an illustration of a weapon case is depicted in accordance with an advantageous embodiment. Weapon case 600 is an illustrative example of one implementation of weapon case 100 in FIG. 1.

Weapon case 600 may depict a self-inflating, compressible container suitable for a weapon such as a pistol or handgun, for example. Weapon case 600 includes inflatable portion 602, non-inflatable portion 604, opening 606, strap 608, male clip 610, female clip 612, nozzle 614, loops 616, and belt clip 618. Inflatable portion 602 is an illustrative example of one implementation of inflatable portion 102 in FIG. 1. Non-inflatable portion 604 is an illustrative example of one implementation of non-inflatable portion 118 in FIG. 1.

Opening 606 is provided to insert and remove an object, such as a weapon, from weapon case 600. Opening 606 is sealed by rolling non-inflatable portion 604 in a compressed manner towards the area where non-inflatable portion 604 connects with inflatable portion 602, and securing rolled and compressed non-inflatable portion 604 using strap 608. Strap 608 includes male clip 610 and female clip 612, in this example, for securing either end of strap 608 together to hold rolled and compressed non-inflatable portion 604 in place.

Nozzle 614 is disposed at the end of inflatable portion 602 opposite from non-inflatable portion 604, in this example. Loops 616 may be disposed along one side of weapon case 600, in this example. Loops 616 provide a mechanism for affixing weapon case 600 to another object or carrying strap by inserting additional material through loops 616, for example. Belt clip 618 may be an illustrative example of one implementation of belt clip 136 in FIG. 1.

The illustration of weapon case 600 in FIG. 6 is not meant to imply physical or architectural limitations to the manner in which different advantageous embodiments may be implemented. Other components in addition and/or in place of the ones illustrated may be used. Some components may be unnecessary in some advantageous embodiments. Also, the blocks are presented to illustrate some functional components. One or more of these blocks may be combined and/or divided into different blocks when implemented in different advantageous embodiments.

Figure 7:
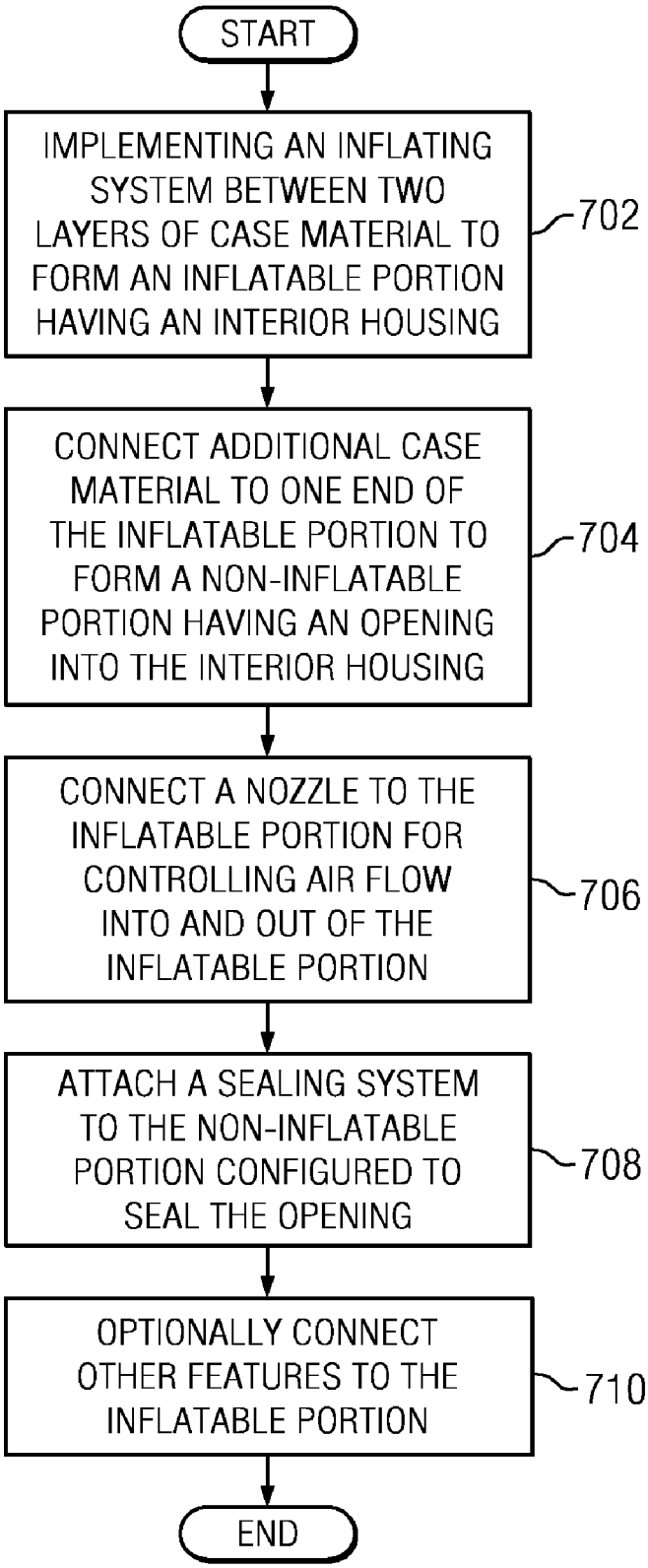
FIG. 7 is an illustration of a flowchart illustrating a process for providing a compressible protective weapon case in accordance with an advantageous embodiment.

With reference now to FIG. 7, an illustration of a flowchart illustrating a process for providing a compressible protective weapon case is depicted in accordance with an advantageous embodiment. The process in FIG. 7 may be used to implement a component, such as weapon case 100 in FIG. 1, for example.

The process begins by implementing an inflating system between two layers of case material to form an inflatable portion having an interior housing (step 702). The inflating system may include, for example, without limitation, a number of baffling features for creating air passages within the interior cavity formed by the two layers of case material, for example, such as number of baffling features 114 in FIG. 1. The two layers of case material may be an illustrative example of one implementation of number of layers 112 in FIG. 1. The case material may be, for example, without limitation, nylon, polyester, polyethylene, impregnated fabric, coated fabric, and/or any other suitable material. The interior housing is the space between the interior surfaces of each of the two layers of case material, for example.

The process connects additional case material to one end of the inflatable portion to form a non-inflatable portion having an opening into the interior housing (step 704). The non-inflatable portion may be comprised of the same type of material as the case material of the inflatable portion, or a different type of material. In an illustrative example, the non-inflatable portion may be a continuation of one of the two layers of case material that forms the inflatable portion, with the extended layer being sealed off at the point where the non-extended layer stops, to seal in the inflating system in the internal cavity between the two layers. The opening into the interior housing may be used to insert and/or remove an object from the interior housing.

The process connects a nozzle to the inflatable portion for controlling air flow into and out of the inflatable portion (step 706). The nozzle may be, for example, nozzle 106 in FIG. 1. The nozzle may include a closed state and an open state, where the closed state prevents air flow and the open state provides air flow, in one illustrative example. The process attaches a sealing system to the non-inflatable portion configured to seal the opening (step 708). The sealing system may include, for example, without limitation, a strap configured to secure the non-inflatable portion when the non-inflatable portion is compressed and rolled toward the inflatable portion, for example.

The process optionally connects other features to the inflatable portion (step 710), with the process terminating thereafter. The other features may include, for example, without limitation, a handle, a number of eyelets, a number of loops, a belt clip, a carrying strap, and/or any other suitable feature.

The description of the different advantageous embodiments has been presented for purposes of illustration and description, and is not intended to be exhaustive or limited to the embodiments in the form disclosed. Many modifications and variations will be apparent to those of ordinary skill in the art. Further, different advantageous embodiments may provide different advantages as compared to other advantageous embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. An apparatus comprising:

an inflatable weapon case comprising a number of layers of material that form an interior housing and an interior cavity, and an inflating system disposed within the interior cavity, wherein an interior layer of material from the number of layers of material comprises the interior housing, wherein the interior cavity is between the interior layer of material and an exterior layer of material, and wherein the number of layers of material are compressible and impervious to penetration by air and moisture;

a nozzle connected to the inflating system and configured to control fluid flow to and from the inflating system, the nozzle having an open state configured to allow the fluid flow and a closed state configured to prevent the fluid flow, wherein the inflating system further comprises a number of air passages, and wherein the inflating system self-inflates by directing fluid flow into the number of air passages when the nozzle is in the open state; and a non-inflatable portion connected to an end of the inflatable weapon case and having a sealing system configured to seal the interior housing of the inflatable weapon case.

2. The apparatus of claim 1, wherein the sealing system further comprises:

a strap disposed along an end of the non-inflatable portion opposite the end of the inflatable weapon case connected to the non-inflatable portion, wherein the strap is configured to secure the non-inflatable portion in a rolled and compressed state.

3. The apparatus of claim 2, further comprising:

a male clip connected to a first end of the strap; and a female clip connected to a second end of the strap, wherein the male clip and the female clip are configured to complement each other to form a buckle feature.

4. The apparatus of claim 1, further comprising:

a handle connected to an outer layer of material from the number of layers of material, wherein the outer layer of material provides the outer surface of the apparatus.

5. The apparatus of claim 1, further comprising:

a number of eyelets connected to an outer layer of material from the number of layers of material, wherein the number of eyelets provide a mechanism for securing the apparatus to another object.

6. The apparatus of claim 1, further comprising:

a number of loops connected to an outer layer of material from the number of layers of material, wherein the number of loops provide a mechanism for securing the apparatus to another object.

7. The apparatus of claim 1, further comprising:

a belt clip connected to an outer layer of material from the number of layers of material, wherein the belt clip provides a mechanism for securing the apparatus to another object.

8. The apparatus of claim 1, further comprising:

a handle connected to an outer layer of material from the number of layers of material.

9. The apparatus of claim 1, wherein the number of layers of material are selected from at least one of nylon, polyester, polyethylene, impregnated fabric, and coated fabric.

10. The apparatus of claim 1, wherein the inflatable weapon case includes an inflated state and a deflated state.

11. The apparatus of claim 10, wherein the inflatable weapon case is configured to be compressed and rolled in the deflated state to form a deflated, rolled, and compressed apparatus.

12. The apparatus of claim 1, wherein the non-inflatable portion is comprised of a material that is compressible and impervious to penetration by air and moisture.

13. A method comprising:

positioning a nozzle in an open state, wherein the nozzle is connected to an inflating system disposed within an interior cavity formed from two layers of material, the two layers of material further comprising an interior layer and an exterior layer, the interior layer forming an interior housing of an inflatable weapon case, and wherein the positioning of the nozzle in the open state allows air flow to enter and fill a number of air passages within the interior cavity to self-inflate the inflatable weapon case; and positioning the nozzle in a closed state once the number of air passages are filled with air, wherein the positioning of the nozzle in the closed state prevents the flow of the air and maintains air pressure acquired by the air filling the number of air passages within the interior cavity.

14. The method of claim 13 further comprising:

positioning the nozzle in the open state; and compressing the inflatable weapon case to expel the air from the number of air passages.

15. The method of claim 13, further comprising:

connecting other features to the inflatable weapon case.

16. The method of claim 15, wherein the other features include at least one of a handle, a number of eyelets, a number of loops, a belt clip, and a carrying strap.

* * * * *